US009335081B2

(12) United States Patent
Son et al.

(10) Patent No.: US 9,335,081 B2
(45) Date of Patent: May 10, 2016

(54) ICE MAKER AND ICE MAKING METHOD USING THE SAME

(75) Inventors: Juhyun Son, Gyeongsangnam-do (KR); Wookyong Lee, Gyeongsangnam-do (KR); Donghoon Lee, Gyeongsangnam-do (KR); Dongjeong Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 849 days.

(21) Appl. No.: 13/613,405

(22) Filed: Sep. 13, 2012

(65) Prior Publication Data

US 2013/0081412 A1 Apr. 4, 2013

(30) Foreign Application Priority Data

Oct. 4, 2011 (KR) ..... 10-2011-0100480

(51) Int. Cl.
*F25C 1/10* (2006.01)
*F25C 1/04* (2006.01)
*F25C 5/04* (2006.01)

(52) U.S. Cl.
CPC ... *F25C 1/04* (2013.01); *F25C 5/04* (2013.01); *F25C 2305/022* (2013.01)

(58) Field of Classification Search
CPC ..... F25C 1/04; F25C 1/045; F25C 1/06; F25C 1/10; F25C 1/22; F25C 2305/00; F25C 2305/022
See application file for complete search history.

(56) References Cited

U.S. PATENT DOCUMENTS 2,083,081 A * 6/1937 Moll ..... 249/120
2,407,058 A * 9/1946 Clum ..... 62/137
2,526,262 A * 10/1950 Munshower ..... 62/137
2,757,519 A * 8/1956 Sampson ..... 62/71
3,004,405 A * 10/1961 Upchurch ..... 62/353
3,059,445 A * 10/1962 Kniffin ..... 62/135
3,580,007 A * 5/1971 Bauerlein ..... 62/345
4,366,679 A * 1/1983 Van Steenburgh, Jr. ..... 62/347
4,852,359 A * 8/1989 Manzotti ..... F25C 1/10 62/353
4,909,039 A * 3/1990 Yamada et al. ..... 62/66
4,910,974 A * 3/1990 Hara ..... 62/347
7,665,316 B2 * 2/2010 Ito et al. ..... 62/135
2004/0099004 A1 * 5/2004 Somura ..... 62/347
2006/0032249 A1 * 2/2006 Shim ..... F25D 23/126 62/135
2006/0086134 A1 * 4/2006 Voglewede et al. ..... 62/351
2010/0147011 A1 * 6/2010 Kang ..... F25C 1/04 62/344
2010/0205996 A1 * 8/2010 Ducharme et al. ..... 62/351
2010/0212340 A1 * 8/2010 Kuratani ..... 62/137
2012/0023996 A1 * 2/2012 Herrera et al. ..... 62/340

FOREIGN PATENT DOCUMENTS

CN 1719165 A 1/2006
JP 1998-158070 U 10/1989

(Continued)

*Primary Examiner* — Frantz Jules
*Assistant Examiner* — Erik Mendoza-Wilkenfel
(74) *Attorney, Agent, or Firm* — Fish & Richardson P.C.

(57) ABSTRACT

Provided is an ice maker, which includes an upper tray, a lower tray, and a rotation shaft. Upper cells of hemispherical shapes are arrayed in the upper tray. Lower cells of hemispherical shapes are arrayed in the lower tray that is rotatably connected to the upper tray. The rotation shaft is connected to a rear end of the lower tray and a rear end of the upper tray to rotate the lower tray relative to the upper tray. A rotation guide part rounded with a predetermined curvature is disposed in a region where the lower tray contacts the upper tray while the lower tray is rotated.

19 Claims, 9 Drawing Sheets

(56) References Cited

FOREIGN PATENT DOCUMENTS

| | | | |
|---|---|---|---|
| JP | H 02-143068 | A | 6/1990 |
| JP | H 02-176380 | A | 7/1990 |
| JP | H 05-032978 | A | 2/1993 |
| JP | 2003-121038 | A | 4/2003 |
| JP | 2005326035 | A | * 11/2005 |
| JP | 2008-170086 | A | 7/2008 |
| KR | 10-2011-0037609 | A | 4/2011 |

* cited by examiner

ICE MAKER AND ICE MAKING METHOD USING THE SAME

CROSS-REFERENCE TO RELATED APPLICATIONS

The present application claims the benefit of priority under 35 U.S.C. 119 to Korean Patent Application No. 10-2011-0100480 (filed on Oct. 4, 2011), which is hereby incorporated by reference in its entirety.

FIELD

The present disclosure relates to an ice maker provided on a refrigerator, and an ice making method using the ice maker.

BACKGROUND

In general, refrigerators are home appliances for storing food at a low temperature in an inner storage space covered by a door. Since a refrigerator cools the inside of a storage space by using cool air, foods stored in the storage space may be stored in a refrigerated or frozen state.

Also, an ice maker for making ice may be provided inside the refrigerator. The ice maker is configured such that water supplied from a water supply source or a water tank is received into an ice tray to make ice. Also, the ice maker is configured to separate the made ice from the ice tray in a heating or twisting manner.

As described above, the ice maker in which water is automatically supplied and ice is automatically separated may have a structure which is opened upward to lift the made ice up. Also, an ice made in the ice maker having the above-described structure may have a shape having at least one flat surface, such as a crescent moon shape or a cubic shape.

SUMMARY

In one aspect, an ice maker includes an upper tray having upper cells that each has a hemispherical shape and a lower tray having lower cells that each has a hemispherical shape. The lower tray is rotatably connected to the upper tray. The ice maker also includes a rotation shaft connected to the lower tray and the upper tray and configured to rotate the lower tray relative to the upper tray. The ice maker further includes a rotation guide part that is rounded with a predetermined curvature and that is disposed in a region where the lower tray contacts the upper tray during rotation of the lower tray.

Implementations may include one or more of the following features. For example, the ice maker may include a pair of links each having a first end connected to the lower tray and a second end connected to the upper tray and a plurality of link guides extending upward from both side ends of the upper tray. In this example, the ice maker may include an upper ejecting pin assembly connected to the links and having both ends inserted in the link guides. Also, in this example, the connection of the upper ejecting pin assembly to the links may cause the upper ejecting pin assembly to move up and down with rotation of the lower tray in a manner guided by the link guides.

In some implementations, the upper ejecting pin assembly may include a pin body having both ends connected to the links, respectively, and a plurality of ejecting pins extending downward from the pin body. In these implementations, positions of the plurality of ejecting pins may correspond to positions of the upper cells. Further, in these implementations, each of the upper cells may have an air hole defined in a top surface thereof and the positions of the plurality of ejecting pins may correspond to positions of air holes defined in the upper cells.

In addition, the ice maker may include lower ejecting pins that press bottom surfaces of the lower cells in response to the lower tray being rotated away from the upper tray to an ice removing position. The rotation guide part may be disposed on the upper tray and may be rounded with a predetermined curvature that accommodates the lower tray during rotation of the lower tray. Also, the rotation guide part may be disposed on the lower tray and may be rounded with a predetermined curvature that accommodates the upper tray during rotation of the lower tray.

In some examples, the rotation guide part may include a first rotation guide part disposed on the upper tray and rounded with a first predetermined curvature. In these examples, the rotation guide part also may include a second rotation guide part disposed on the lower tray and rounded with a second predetermined curvature. The second predetermined curvature may complement the first predetermined curvature and, during rotation of the lower tray, the second rotation guide part may contact the first rotation guide part in a manner that guides rotation of the lower tray relative to the upper tray.

In another aspect, an ice making method using an ice maker includes rotating a lower tray to a water supplying position. The lower tray has lower cells that each has a hemispherical shape and the lower tray is rotatably connected to an upper tray having upper cells that each has a hemispherical shape. The method also includes supplying water to the lower tray in the water supplying position and, after supplying the water to the lower tray in the water supplying position, rotating the lower tray, from the water supplying position, to a contacting position that contacts the upper tray and engages the lower cells of the lower tray with the upper cells of the upper tray, thereby trapping water supplied to the lower tray between the lower cells of the lower tray and the upper cells of the upper tray. The method further includes enabling ice to form from the water trapped between the lower cells of the lower tray and the upper cells of the upper tray and, after ice has formed from the water trapped between the lower cells of the lower tray and the upper cells of the upper tray, rotating the lower tray, from the contacting position, to an ice separating position in which ice pieces remaining in the lower cells separate from the lower cells.

Implementations may include one or more of the following features. For example, the method may include rotating the lower tray to the water supplying position in which the lower tray is inclined downward from a horizontal line. The method also may include operating an ice separating heater before the rotation of the lower tray to the ice separating position and after ice has formed from the water trapped between the lower cells of the lower tray and the upper cells of the upper tray. The method further may include moving upper ejecting pins downward simultaneously with the rotation of the lower tray to the ice separating position. The upper ejecting pins may pass through the upper cells to separate ice pieces remaining in the upper cells from the upper cells.

In some implementations, the method may include rotating the lower tray through a set angle or greater, thereby causing lower ejecting pins to pass through the lower cells to separate ice pieces remaining in the lower cells from the lower cells. In addition, the method may include rotating the lower tray about a rotation guide part that is rounded with a predetermined curvature and that is disposed in a region where the lower tray contacts the upper tray during rotation of the lower tray.

In yet another aspect, a refrigerator includes a refrigerating compartment, a freezing compartment, and an ice maker configured to freeze water into ice. The ice maker includes an upper tray having upper cells that each has a hemispherical shape and a lower tray having lower cells that each has a hemispherical shape. The lower tray is rotatably connected to the upper tray. The ice maker also may include a rotation shaft connected to the lower tray and the upper tray and configured to rotate the lower tray relative to the upper tray. The ice maker further may include a rotation guide part that is rounded with a predetermined curvature and that is disposed in a region where the lower tray contacts the upper tray during rotation of the lower tray.

Implementations may include one or more of the following features. For example, the ice maker may include a pair of links each having a first end connected to the lower tray and a second end connected to the upper tray and a plurality of link guides extending upward from both side ends of the upper tray. In this example, the ice maker may include an upper ejecting pin assembly connected to the links and having both ends inserted in the link guides. Also, in this example, the connection of the upper ejecting pin assembly to the links may cause the upper ejecting pin assembly to move up and down with rotation of the lower tray in a manner guided by the link guides.

In addition, the rotation guide part may be disposed on the upper tray and may be rounded with a predetermined curvature that accommodates the lower tray during rotation of the lower tray. The rotation guide part may be disposed on the lower tray and may be rounded with a predetermined curvature that accommodates the upper tray during rotation of the lower tray. The ice maker may be located within the freezing compartment.

In some implementations, the rotation guide part may include a first rotation guide part disposed on the upper tray and rounded with a first predetermined curvature. In these implementations, the rotation guide part also may include a second rotation guide part disposed on the lower tray and rounded with a second predetermined curvature. The second predetermined curvature may complement the first predetermined curvature and, during rotation of the lower tray, the second rotation guide part may contact the first rotation guide part in a manner that guides rotation of the lower tray relative to the upper tray.

The details of one or more implementations are set forth in the accompanying drawings and the description below. Other features will be apparent from the description and drawings, and from the claims.

DETAILED DESCRIPTION

In some implementations, pressing type ice makers are described. In these implementations, the pressing type ice makers make ice by collecting water in a lower tray, and then, bringing the lower tray into tight contact with an upper tray to reduce (e.g., prevent) water leakage.

Figure 1:
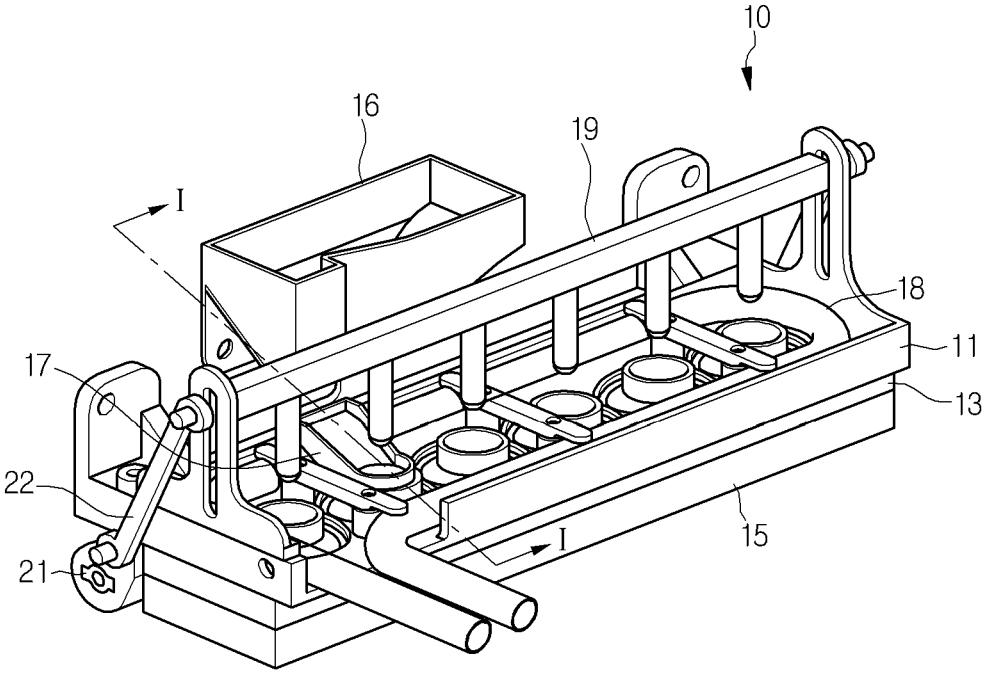
FIG. 1 is a perspective view illustrating an ice maker performing an ice making process.
Figure 2:
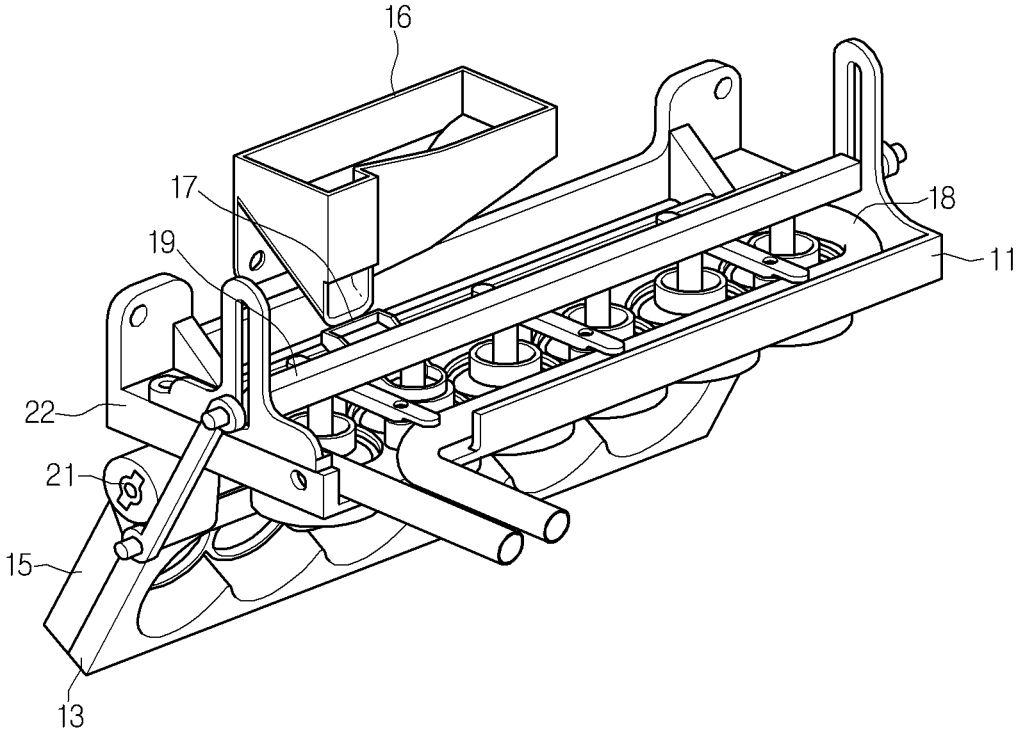
FIG. 2 is a perspective view illustrating the ice maker of FIG. 1 when ice has been separated.
Figure 3:
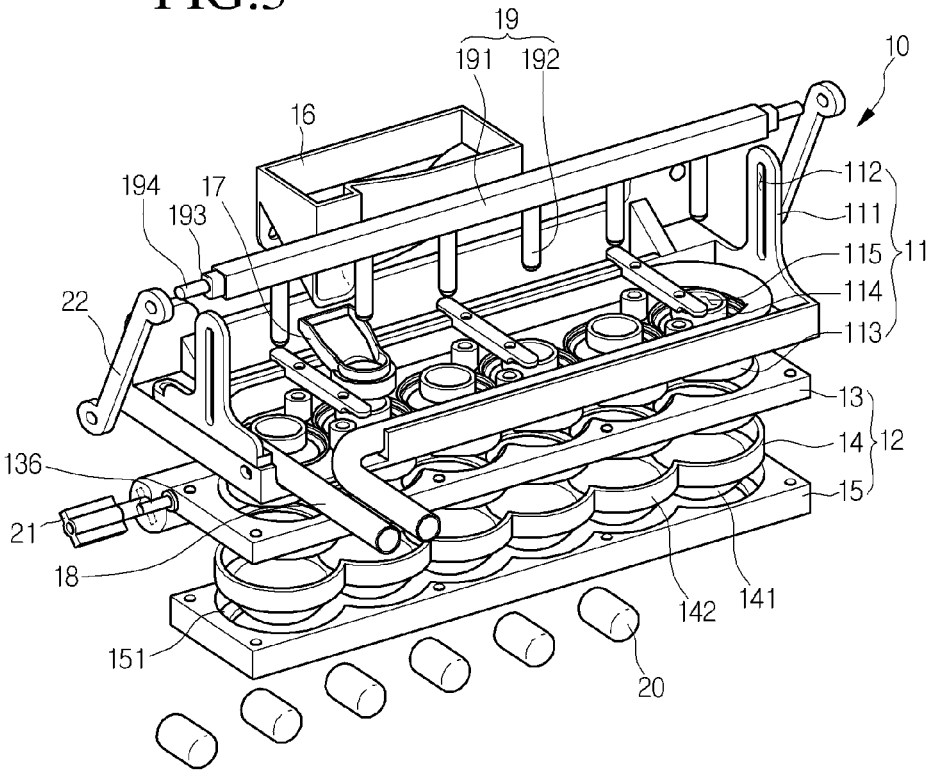
FIG. 3 is an exploded perspective view illustrating the ice maker of FIG. 1.

FIG. 1 illustrates an example ice maker performing an example ice making process. FIG. 2 illustrates the ice maker of FIG. 1 when ice has been separated. FIG. 3 illustrates the ice maker of FIG. 1 in an exploded format.

Referring to FIGS. 1 to 3, an ice maker 10 includes: an upper tray 11 that makes ice in an upper hemisphere region at the upper side of a horizontal surface for bisecting a spherical ice piece; a lower tray 12 that makes ice in a lower hemisphere region; a water supply tray disposed above the upper tray 11 to supply water for making ice; a water supply guide 17 guiding the water from the water supply tray 16 to the lower tray 12; an ice separating heater 18 placed on a top surface of the upper tray 11, and heating the upper tray 11 to separate ice; an upper ejecting pin assembly 19 that separates ice from upper cells 113 of the upper tray 11; a rotation shaft 21 rotatably connecting the lower tray 12 to the upper tray 11; a plurality of links 22 having an end connected to the upper ejecting pin assembly 19, and the other end connected to the lower tray 12; and a plurality of lower ejecting pins 20 that remove ice from the lower tray 12.

In detail, the rear end of the lower tray 12 is rotatably coupled to the rear end of the upper tray 11 by the rotation shaft 21. A link connecting end 136 protrudes from a portion of the lower tray 12 adjacent to the rotation shaft 21. The second end of the link 22 is connected to the link connecting end 136 to upwardly and downwardly move the upper ejecting pin assembly 19 during rotation of the lower tray 12.

In more detail, the lower tray 12 includes: a tray body 14 including lower cells 141; a lower frame 15 including a tray body seating part 151 on which the tray body 14 is seated; and an upper frame 13 having a bottom surface to which the tray body 14 and the lower frame 15 are fixed.

The tray body seating part 151 disposed in the lower frame 15 includes a plurality of holes through which the lower cells 141 of the tray body 14 pass, and protrusion parts disposed at edges of the holes to catch the tray body 14.

Each of the lower cells 141 arrayed in the tray body 14 has a hemispherical shape. An extension end 143 (refer to FIG. 8) extends radially from a top edge of the lower cells 141, and a guide wall 142 extends a predetermined height from an end of the extension end 143. The extension end 143 and the guide wall 142 are placed on the tray body seating part 151 of the lower frame 15 to block the tray body from being removed from the lower frame 15. The lower ejecting pins 20, the number of which corresponds to the number of the lower cells 141, horizontally protrude under the lower tray 12. The lower cells 141 pass through the lower frame 15, and are exposed to the outside. Thus, when the lower tray 12 is rotated downward to separate ice, the bottom surfaces of the lower cells 141 are pressed by the lower ejecting pins 20. The lower cells 141 may include a soft plastic member tending to return to its original sate after deformation. Thus, spherical ice pieces are separated from the lower cells 141 by the lower ejecting pins 20 pressing the bottom surfaces of the lower cells 141.

The rotation shaft 21 passes through the rear end of the upper frame 13, particularly, through both edges of the rear end. Link connecting ends 136 protrude from both side surfaces of the rear end of the upper frame 13.

Each of the upper cells 113 arrayed in the upper tray 11 has a hemispherical shape, and tightly contacts each of the lower cells 141 to form a spherical space therein.

Guide sleeves 114 protrude from top surfaces of the upper cells 113, respectively, to form air holes 115. An end of the water supply guide 17 is fitted on the outer circumferential surface of one of the guide sleeves 114. In detail, a sleeve having the same outer diameter as that of the guide sleeves 114 is disposed on an outlet end of the water supply guide 17 to supply water from the water supply tray 16 to the lower cells 141 with reduced water leakage.

Link guides 111 upwardly extend a predetermined length from the left and right edges of the upper tray 11. Guide holes 112 vertically extend with a predetermined width in the link guides 111.

The ice separating heater 18 is placed on the top surface of the upper tray 11. The ice separating heater 18 heats the outer surfaces of the upper cells 113. Accordingly, ice stuck to the upper cells 113 is slightly melted and is separated therefrom.

The upper ejecting pin assembly 19 includes a plurality of ejecting pins 192, and a pin body 191 to which the ejecting pins 192 are attached. In detail, guide protrusions 193 protrude from both ends of the pin body 191, and link connecting ends 194 protrude from the guide protrusions 193. The guide protrusions 193 are inserted in the guide holes 112 of the link guides 111, so that the guide protrusions 193 can be moved upward or downward along the guide holes 112. The first end of the link 22 is connected to the link connecting end 194. The ejecting pins 192 are disposed in locations, respectively, to pass through the air holes 115 disposed in the top surfaces of the upper cells 113. Thus, when the ejecting pins 192 are moved downward, the ejecting pins 192 pass through the air holes 115, and push out ice from the upper cells 113.

Figure 4:
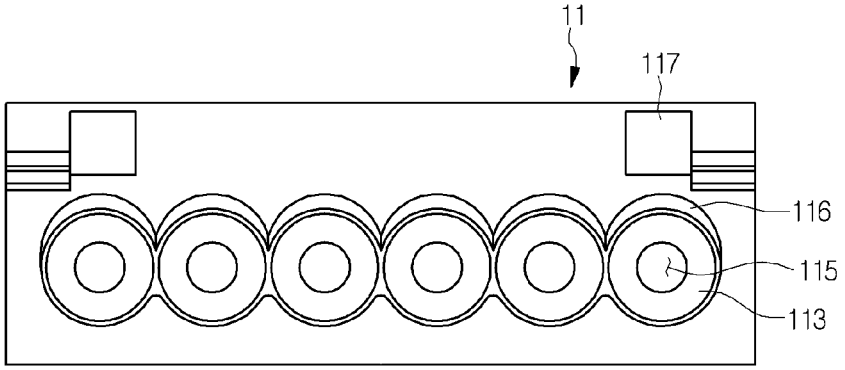
FIG. 4 is a bottom view illustrating an upper tray constituting the ice maker of FIG. 1.

FIG. 4 illustrates the upper tray constituting the ice maker of FIG. 1 from a bottom view.

Referring to FIG. 4, the upper cells 113 neighbor one another in the upper tray 11, and protrude in a hemispherical shape.

The air holes 115 are disposed in the top surfaces of the upper cells 113, respectively. Rotation guide parts 116 are rounded with a predetermined curvature at rear edges of the upper cells 113. Shaft connecting parts 117 are disposed at the rear left and right ends of the upper tray 11, respectively. Both ends of the rotation shaft 21 pass through the shaft connecting parts 117, so that the lower tray 12 is rotatably connected thereto. Spaces are disposed between the shaft connecting parts 117 and both side edges of the upper tray 11 to accommodate shaft connecting parts 135 (see FIG. 5) disposed at the rear corners of the upper frame 13. Thus, each of both the ends of the rotation shaft 21 sequentially passes through the shaft connecting part 117 of the upper tray 11 and the shaft connecting part 135 of the upper frame 13.

Functions of the rotation guide parts 116 will be described in more detail later with reference to the accompanying drawings.

Figure 5:
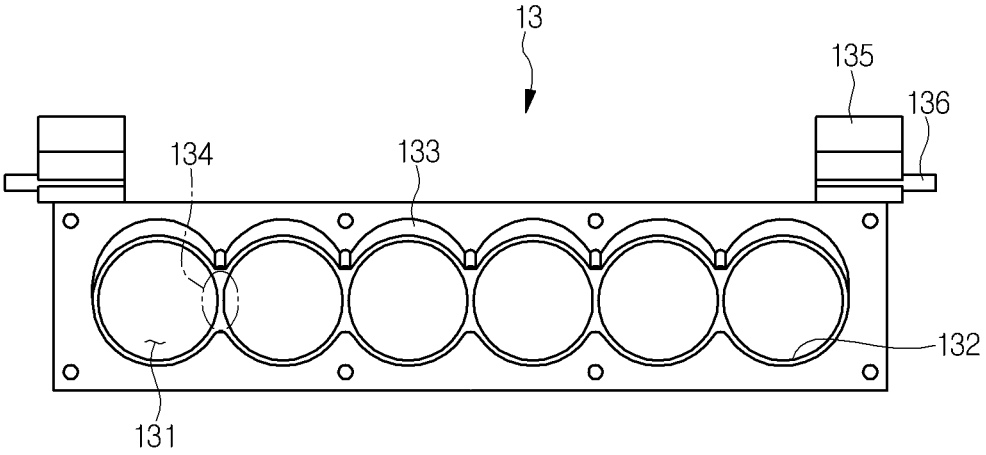
FIG. 5 is a plan view illustrating an upper frame constituting the ice maker of FIG. 1.

FIG. 5 illustrates the upper frame constituting the ice maker of FIG. 1 from a plan view.

Referring to FIG. 5, the upper frame 13 constitutes the lower tray 12, and is placed on a top surface of the tray body 14. The tray body 14 and the lower frame 15 are fixed to the bottom surface of the upper frame 13.

In detail, the shaft connecting parts 135 protrude from the rear corners of the upper frame 13, and the link connecting ends 136 protrude from outer surfaces of the shaft connecting parts 135.

Communication holes 131 are arrayed within the upper frame 13, and have the same diameter as that of respective top surfaces of the lower cells 141 of the tray body 14. In detail, the communication holes 131 are placed on the top surfaces of the lower cells 141, and the bottom surfaces of the upper cells 113 are placed on the tops of the communication holes 131. Protrusion parts 132 are disposed at edges of the communication holes 131. When a water level reaches the height of the protrusion parts 132, the lower tray 12 is rotated to tightly contact the upper tray 11.

Unlike the front edges of the communication holes 131, the rear edges thereof are provided with rotation guide parts 133 that are rounded with a predetermined curvature. In other words, the protrusion parts 132 are horizontally and vertically extended from the front edges of the communication holes 131, whereas protrusion parts, that is, the rotation guide parts 133 are horizontally extended from the rear edges of the communication holes 131, and are then rounded upward with a predetermined curvature. The curvature of the rotation guide parts 133 is the same as that of the rotation guide parts 116 of the upper tray 11. When the lower tray 12 is rotated, the rotation guide parts 133 of the upper frame 13 are rotated, contacting the rotation guide parts 116 of the upper tray 11.

Water runners 134 are disposed between the communication holes 131, and are formed by discontinuity between the protrusion parts 132 and the rotation guide parts 133. In other words, the protrusion parts 132 and the rotation guide parts 133, which are not recessed and face each other, form the water runners 134 on the upper frame 13 between the communication holes 131. This may be used because the ice maker 10 is a pressing type one in which, when a water supply process has been completed, an upper tray tightly contacts a lower tray. The water runners 134 are sufficiently large in width and height. Thus, even when water is rapidly supplied, the water is blocked from flowing over a tray.

For example, a reservoir type ice maker in which water is supplied in a state that an upper tray tightly contacts a lower tray to form a complete sphere in a cell includes water runners provided in the form of recesses in the upper tray and/or the lower tray to transfer water from a cell disposed in a water supplying position to the next cells. When the water runners are significantly small in width and depth, a transfer rate of water to the next cell is significantly lower than a water supply rate, whereby water may flow over. On the contrary, when the water runners are significantly large in width and depth, it may be difficult to form a completely spherical ice piece, but also neighboring ice pieces may stick to each other.

Figure 6:
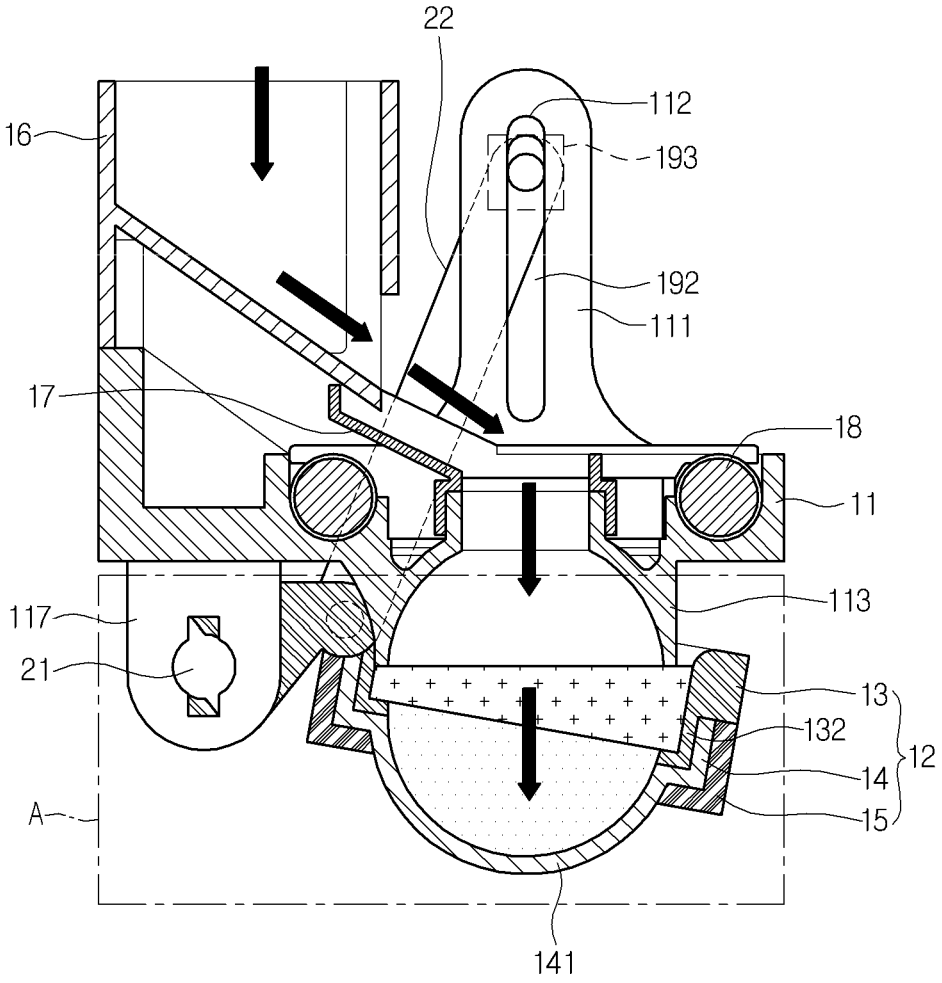
FIG. 6 is a cross-sectional view taken along line I-I of FIG. 1 in a water supply state.
Figure 7:
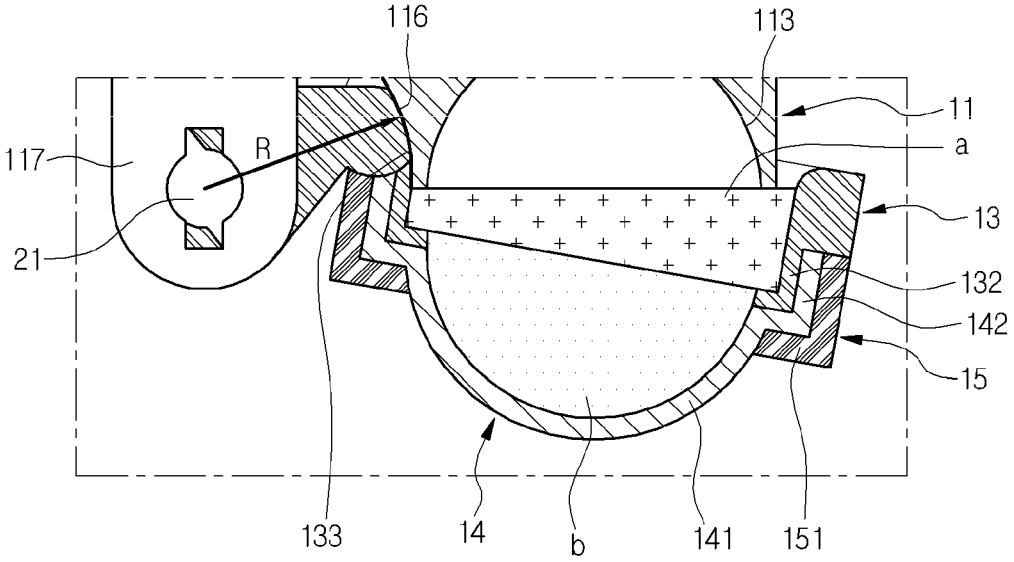
FIG. 7 is an enlarged view illustrating a portion A of FIG. 6.
Figure 8:
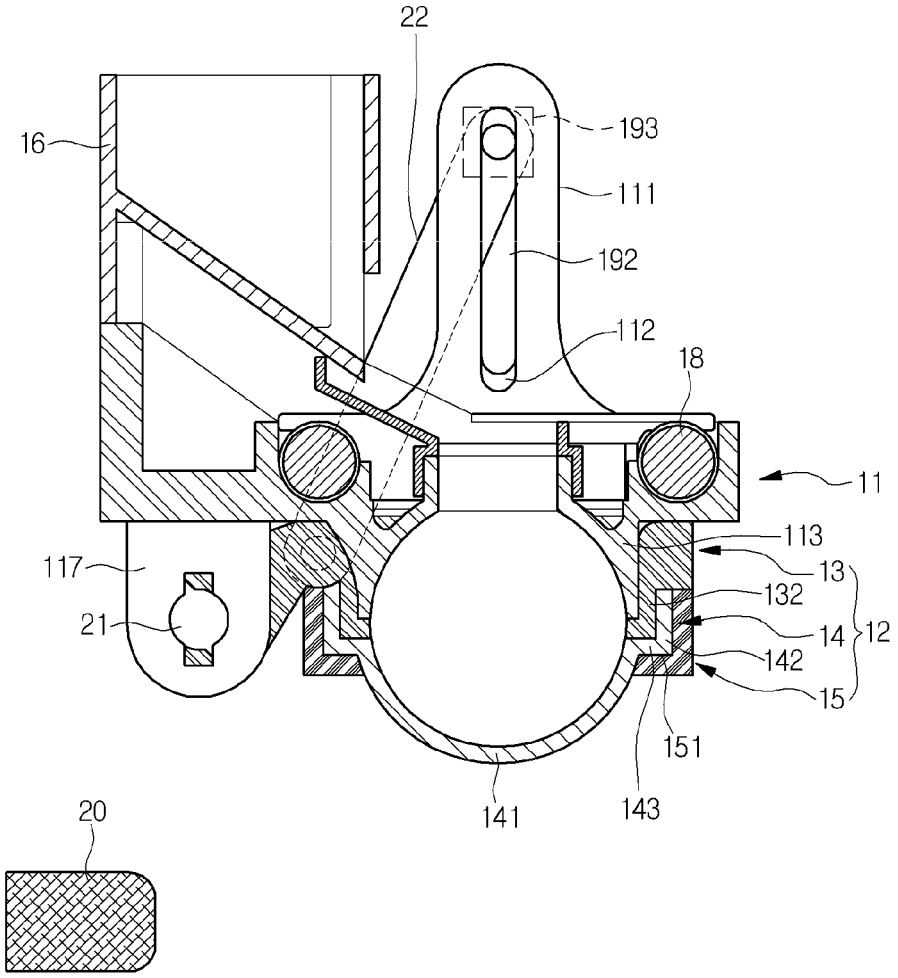
FIG. 8 is a cross-sectional view taken along line I-I of FIG. 1 in an ice making state.
Figure 9:
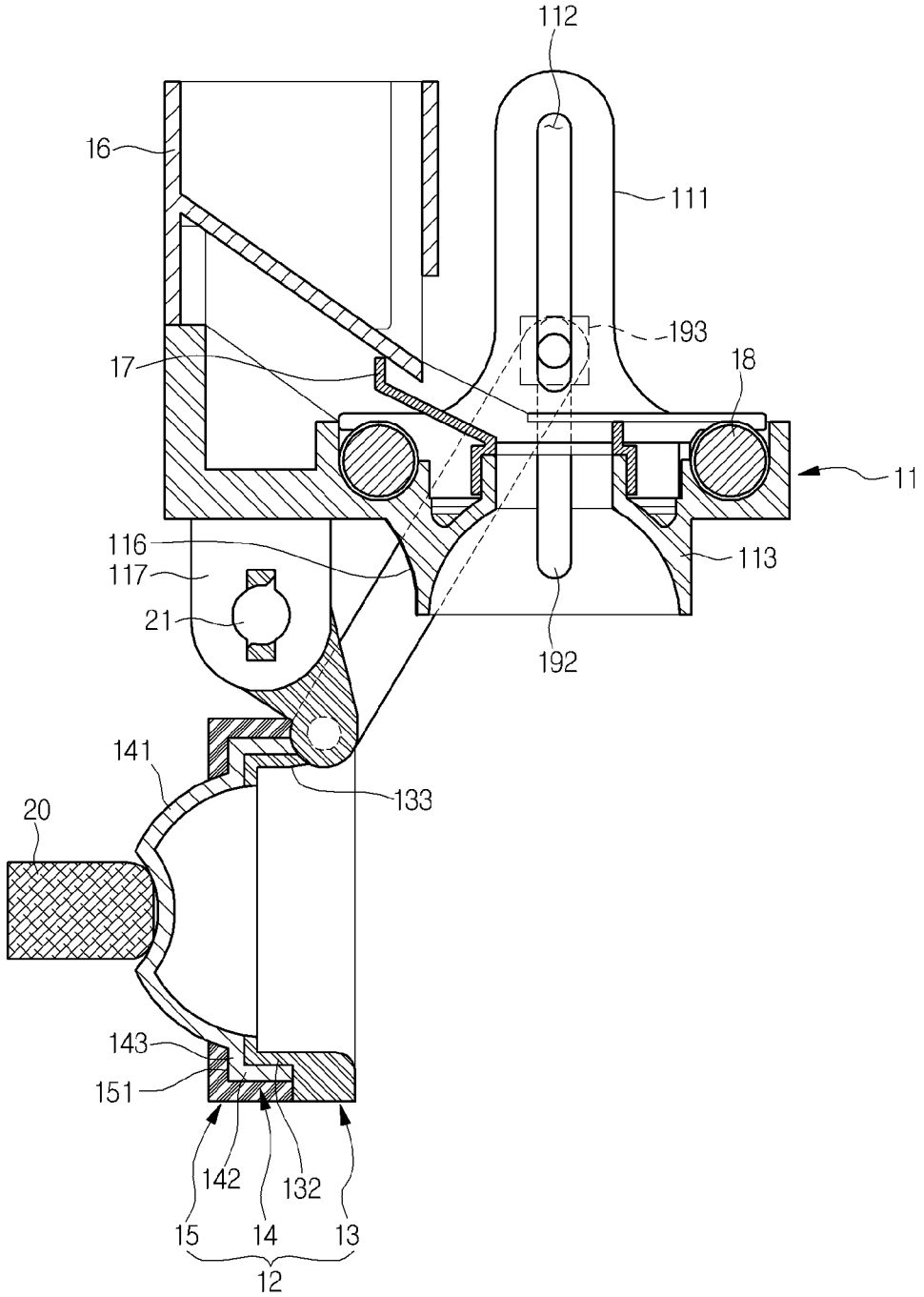
FIG. 9 is a cross-sectional view taken along line I-I of FIG. 1 in a completely separated ice state.

FIGS. 6 to 9 illustrate an example process of the ice maker of FIG. 1 from a water supply state to an ice separating state. In particular, FIG. 6 is a cross-sectional view taken along line I-I of FIG. 1 in a water supply state. FIG. 7 is an enlarged view illustrating a portion A of FIG. 6. FIG. 8 is a cross-sectional view taken along line I-I of FIG. 1 in an ice making state. FIG. 9 is a cross-sectional view taken along line I-I of FIG. 1 in a completely separated ice state.

Referring to FIGS. 6 and 7, the lower tray 12 is rotated downward through a predetermined angle from a horizontal state just before water is supplied. That is, when the lower tray 12 is removed downward from the upper tray 11, water is supplied.

As described above, the ice maker 10 is a pressing type one, which makes ice by filling the lower tray 12 with water for making ice, and then, bringing the lower tray 12 into tight contact with the upper tray 11.

Thus, water is supplied with the lower tray 12 slightly inclined and spaced away from the upper tray 11. Referring to FIG. 7, water is supplied until a water level reaches the tops of the protrusion parts 132 of the upper frame 13. The volume of water filling a region b is substantially the same as that of the lower cell 141, and the volume of water filling a region a is slightly smaller than or is substantially the same as that of the upper cell 113. When the region a is filled with water, the supplying of water is stopped, and the rotation shaft 21 is rotated counterclockwise on the basis of the drawing to bring the lower tray 12 into complete and tight contact with the upper tray 11.

At this point, the rotation guide parts 133 disposed in the rear portion of the upper frame 13 rotate along the rotation guide parts 116 disposed in the rear portion of the upper tray 11 in a state that the rotation guide parts 133 tightly contact the rotation guide parts 116. Both the rotation guide part 133 and the rotation guide part 116 have a radius R of curvature.

As such, when the lower tray 12 rotates in a state of connecting to the upper tray 11, a contact portion thereof is rounded with a predetermined curvature. Thus, when the lower tray 12 tightly contacts the upper tray 11, or is removed therefrom, a linear motion may be unnecessary. In other words, even though the lower tray 12 tightly contacts the upper tray 11 through a rotational motion, water does not flow over the lower tray 12.

Referring to FIG. 8, when the lower tray 12 is rotated, and completely and tightly contacts the upper tray 11, the upper cells 113 of the upper tray 11 completely and tightly contact the protrusion parts 132 of the upper frame 13. That is, the water stored in the lower tray 12 is blocked from leaking out of a spherical cell. The water filling the region a of FIG. 7 fills the upper cell 113 of the upper tray 11 according to the rotation of the lower tray 12. In addition, the lower end of the upper cells 113 completely and tightly contacts the communication holes 131 of the upper frame 13, thus reducing the likelihood of ice pieces formed within neighboring cells from being stuck to each other.

At this point, the rotation shaft 21 is rotated counterclockwise to bring the lower tray 12 into tight contact with the upper tray 11, and simultaneously, to upwardly rotate the link connecting ends 136. In addition, the second ends of the links 22 connected to the link connecting ends 136 are moved upward, to thereby upwardly move the upper ejecting pins assembly 19 connected to the first ends of the links 22. In addition, the ejecting pins 192 are also moved upward out of the upper cells 113 of the upper tray 11.

Referring to FIG. 9, when ice pieces are completely made and an ice separating process is performed, the ice separating heater 18 is operated to melt the ice pieces that are made within spherical cells and are stuck to surfaces of the upper cells 113. Then, the ice pieces are separated from the upper cells 113. After that, the rotation shaft 21 is rotated to rotate the lower tray 12 clockwise. Then, the ice pieces stuck to the lower cells 141 of the lower tray 12 are rotated together with the lower tray 12.

According to the rotation of the lower tray 12, the links 22 are moved downward, and the ejecting pins 192 protruding from the upper ejecting pin assembly 19 are inserted into the upper cells 113 through the air holes 115 of the upper cells 113. Accordingly, ice pieces still stuck to the upper cells 113 are removed therefrom.

When the lower tray 12 is rotated to a substantially vertical state, the lower ejecting pins 20 press the bottom surfaces of the lower cells 141 to remove the ice pieces from the lower cells 141. When the ice pieces are completely separated, the lower tray 12 is oppositely rotated and stopped in the state of FIG. 6. Simultaneously, the bottom surfaces of the lower cells 141 return to the hemispherical shapes thereof based on elastic force of the material used to make the lower cells 141.

Figure 10:
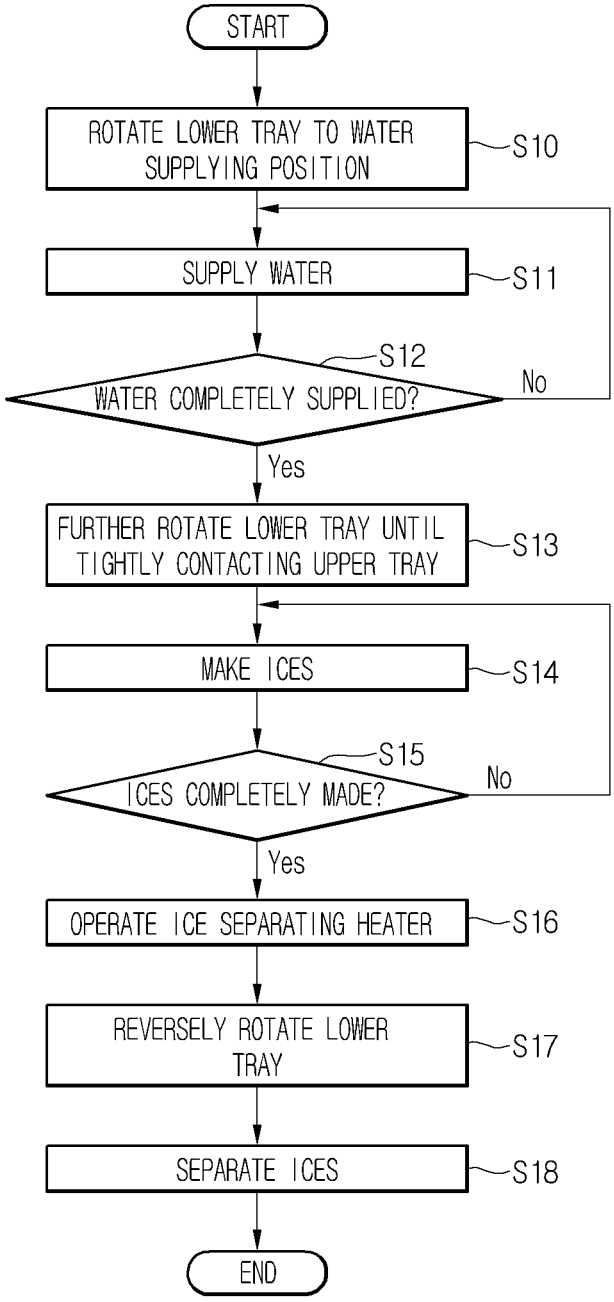
FIG. 10 is a flowchart illustrating an ice making process of an ice maker.

FIG. 10 illustrates an example ice making process of an example ice maker.

The water supply process, ice making process, and ice separating process, which are described with reference to FIGS. 6 to 9, will now be described in more detail.

Referring to FIG. 10, in operation S10, the lower tray 12 is forwardly rotated to a water supplying position (refer to FIG. 6). Water is supplied in operation S11. If it is determined in operation S12 that water is completely supplied, the lower tray 12 is further rotated in operation S13 until tightly contacting the upper tray 11. The ice making process is performed in operation S14.

If it is determined in operation S15 that ice pieces are completely made, the ice separating heater 18 is operated in operation S16 to separate the ice pieces from the surfaces of the upper cells 113. Then, the ice separating heater 18 is stopped, and the lower tray 12 is reversely rotated to an ice separating position in operation S17. When the lower tray 12 is reversely rotated to the ice separating position, the lower ejecting pins 20 press the bottom surface of the lower tray 12 to separate the ice pieces in operation S18.

As described above, although the ice maker is a pressing type one, the lower tray may rotate without a vertical linear motion in both the process that the lower tray tightly contacts the upper tray for making ice pieces after water is completely supplied, and the process that the lower tray is removed from the upper tray for separating the ice pieces. Since a vertical linear motion of the lower tray is not needed in some examples, the designing of a driving mechanism of the ice maker may be simplified.

The ice maker configured as described above and the ice making method using the same may have the following effects.

After water is supplied to the lower tray for making ice, the pressing process for bringing the lower tray into tight contact with the upper tray may be performed by rotating the lower tray about the rotation shaft, without linearly moving the lower tray.

Thus, a driving mechanism for controlling the lower tray may be simplified, and thus, manufacturing costs and a failure rate of the ice maker are decreased. Furthermore, since a linear motion of the lower tray may not be implemented, ice pieces can be made more quickly.

Although implementations have been described with reference to a number of illustrative examples thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice maker comprising:

an upper tray having upper cells that each has a hemispherical shape;

a lower tray having lower cells that each has a hemispherical shape, the lower tray being rotatably connected to the upper tray and being positioned lower than the upper tray;

a rotation shaft connected to the lower tray and the upper tray and configured to rotate the lower tray relative to the upper tray;

a rotation guide part that is rounded with a predetermined curvature and that is disposed in a region where the lower tray contacts the upper tray during rotation of the lower tray; and lower ejecting pins that press bottom surfaces of the lower cells in response to the lower tray being rotated away from the upper tray to an ice removing position.

2. The ice maker according to claim 1, further comprising:

a pair of links each having a first end connected to the lower tray and a second end connected to the upper tray;

a plurality of link guides extending upward from both side ends of the upper tray; and an upper ejecting pin assembly connected to the links and having both ends inserted in the link guides, the connection of the upper ejecting pin assembly to the links causing the upper ejecting pin assembly to move up and down with rotation of the lower tray in a manner guided by the link guides.

3. The ice maker according to claim 2, wherein the upper ejecting pin assembly comprises:

a pin body having both ends connected to the links, respectively; and a plurality of ejecting pins extending downward from the pin body, positions of the plurality of ejecting pins corresponding to positions of the upper cells.

4. The ice maker according to claim 3, wherein each of the upper cells has an air hole defined in a top surface thereof and the positions of the plurality of ejecting pins correspond to positions of air holes defined in the upper cells.

5. The ice maker according to claim 1, wherein the rotation guide part is disposed on the upper tray and is rounded with a predetermined curvature that accommodates the lower tray during rotation of the lower tray.

6. The ice maker according to claim 1, wherein the rotation guide part is disposed on the lower tray and is rounded with a predetermined curvature that accommodates the upper tray during rotation of the lower tray.

7. The ice maker according to claim 1, wherein the rotation guide part comprises:

a first rotation guide part disposed on the upper tray and rounded with a first predetermined curvature; and a second rotation guide part disposed on the lower tray and rounded with a second predetermined curvature, the second predetermined curvature complementing the first predetermined curvature and, during rotation of the lower tray, the second rotation guide part contacts the first rotation guide part in a manner that guides rotation of the lower tray relative to the upper tray.

8. An ice making method using an ice maker comprising:

rotating a lower tray to a water supplying position, the lower tray having lower cells that each has a hemispherical shape and the lower tray being rotatably connected to an upper tray having upper cells that each has a hemispherical shape;

supplying water to the lower tray in the water supplying position;

after supplying the water to the lower tray in the water supplying position, rotating the lower tray, from the water supplying position, to a contacting position that contacts the upper tray and engages the lower cells of the lower tray with the upper cells of the upper tray, thereby trapping water supplied to the lower tray between the lower cells of the lower tray and the upper cells of the upper tray;

enabling ice to form from the water trapped between the lower cells of the lower tray and the upper cells of the upper tray; and after ice has formed from the water trapped between the lower cells of the lower tray and the upper cells of the upper tray, rotating the lower tray, from the contacting position, to an ice separating position in which ice pieces remaining in the lower cells separate from the lower cells.

9. The method according to claim 8, wherein rotating the lower tray to the water supplying position comprises rotating the lower tray to the water supplying position in which the lower tray is inclined downward from a horizontal line.

10. The method according to claim 8, further comprising operating an ice separating heater before the rotation of the lower tray to the ice separating position and after ice has formed from the water trapped between the lower cells of the lower tray and the upper cells of the upper tray.

11. The method according to claim 10, further comprising moving upper ejecting pins downward simultaneously with the rotation of the lower tray to the ice separating position, the upper ejecting pins passing through the upper cells to separate ice pieces remaining in the upper cells from the upper cells.

12. The method according to claim 11, wherein rotating the lower tray, from the contacting position, to the ice separating position in which ice pieces remaining in the lower cells separate from the lower cells comprises rotating the lower tray through a set angle or greater, thereby causing lower ejecting pins to pass through the lower cells to separate ice pieces remaining in the lower cells from the lower cells.

13. The method according to claim 8, wherein rotating the lower tray, from the water supplying position, to the contacting position that contacts the upper tray and engages the lower cells of the lower tray with the upper cells of the upper tray comprises rotating the lower tray about a rotation guide part that is rounded with a predetermined curvature and that is disposed in a region where the lower tray contacts the upper tray during rotation of the lower tray.

14. A refrigerator comprising:

a refrigerating compartment;

a freezing compartment; and an ice maker configured to freeze water into ice, the ice maker comprising:

an upper tray having upper cells that each has a hemispherical shape;

a lower tray having lower cells that each has a hemispherical shape, the lower tray being rotatably connected to the upper tray and being positioned lower than the upper tray;

a rotation shaft connected to the lower tray and the upper tray and configured to rotate the lower tray relative to the upper tray;

a rotation guide part that is rounded with a predetermined curvature and that is disposed in a region where the lower tray contacts the upper tray during rotation of the lower tray; and lower ejecting pins that press bottom surfaces of the lower cells in response to the lower tray being rotated away from the upper tray to an ice removing position.

15. The refrigerator according to claim 14, wherein the ice maker further comprises:

a pair of links each having a first end connected to the lower tray and a second end connected to the upper tray;

a plurality of link guides extending upward from both side ends of the upper tray; and an upper ejecting pin assembly connected to the links and having both ends inserted in the link guides, the connection of the upper ejecting pin assembly to the links causing the upper ejecting pin assembly to move up and down with rotation of the lower tray in a manner guided by the link guides.

16. The refrigerator according to claim 14, wherein the rotation guide part is disposed on the upper tray and is rounded with a predetermined curvature that accommodates the lower tray during rotation of the lower tray.

17. The refrigerator according to claim 14, wherein the rotation guide part is disposed on the lower tray and is rounded with a predetermined curvature that accommodates the upper tray during rotation of the lower tray.

18. The refrigerator according to claim 14, wherein the rotation guide part comprises:

a first rotation guide part disposed on the upper tray and rounded with a first predetermined curvature; and a second rotation guide part disposed on the lower tray and rounded with a second predetermined curvature, the second predetermined curvature complementing the first predetermined curvature and, during rotation of the lower tray, the second rotation guide part contacts the first rotation guide part in a manner that guides rotation of the lower tray relative to the upper tray.

19. The refrigerator of claim 14, wherein the ice maker is located within the freezing compartment.

* * * * *